US006619625B2

(12) United States Patent
Kiviniitty

(10) Patent No.: US 6,619,625 B2
(45) Date of Patent: Sep. 16, 2003

(54) HOISTING APPARATUS

(75) Inventor: Ari Kiviniitty, Hämeenlinna (FI)

(73) Assignee: KCI Konecranes Plc., Hyvinkaa (FI)

( * ) Notice: Subject to any disclaimer, the term of this patent is extended or adjusted under 35 U.S.C. 154(b) by 0 days.

(21) Appl. No.: 10/166,596

(22) Filed: Jun. 12, 2002

(65) Prior Publication Data

US 2003/0001147 A1 Jan. 2, 2003

Related U.S. Application Data

(63) Continuation of application No. PCT/FI00/01085, filed on Dec. 12, 2000.

(30) Foreign Application Priority Data

Dec. 13, 1999 (FI) ..... 19992673

(51) Int. Cl.[7] ..... B66D 1/14
(52) U.S. Cl. ..... 254/342; 254/341
(58) Field of Search ..... 254/266, 341, 254/342, 362, 374

(56) References Cited

U.S. PATENT DOCUMENTS 2,354,387 A * 7/1944 Lawler ..... 254/342
4,310,146 A * 1/1982 F'Geppert ..... 254/342
4,458,882 A 7/1984 Schorling
4,760,971 A * 8/1988 Hodgetts ..... 254/342
4,860,965 A * 8/1989 Hodgetts ..... 254/342
4,973,893 A 11/1990 Secretan
5,098,068 A * 3/1992 Jussila ..... 254/342
6,250,607 B1 * 6/2001 Strom ..... 254/362

FOREIGN PATENT DOCUMENTS

| | | |
|---|---|---|
| DE | 1 202 956 | 10/1965 |
| DE | 206 361 | 1/1984 |
| GB | 1 377 377 | 12/1974 |
| WO | WO 01/44099 A1 | 6/2001 |

* cited by examiner

*Primary Examiner*—Emmanuel Marcelo
(74) *Attorney, Agent, or Firm*—Birch, Stewart, Kolasch & Birch, LLP

(57) ABSTRACT

A hoisting apparatus comprising a frame (2), a rope drum (3) provided with a groove (12), a hoisting motor (4), a gear (5) and a pinion (6). The hoisting motor (4) is at least partly positioned inside the rope drum (3) supported against the frame (2) by its both ends. The hoisting motor (4) and the gear (5) are supported against the frame (2) only by one end of the rope drum (3), by which end the hoisting motor (4) and the gear (5) are arranged to rotate the rope drum (3) via the pinion (6). The pinion (6) is positioned between a cylinder, which is parallel to the longitudinal axis of the rope drum (3) and defined by the housing (15) of the hoisting motor (4), and the rope drum (3).

9 Claims, 2 Drawing Sheets

HOISTING APPARATUS

Figure 1:
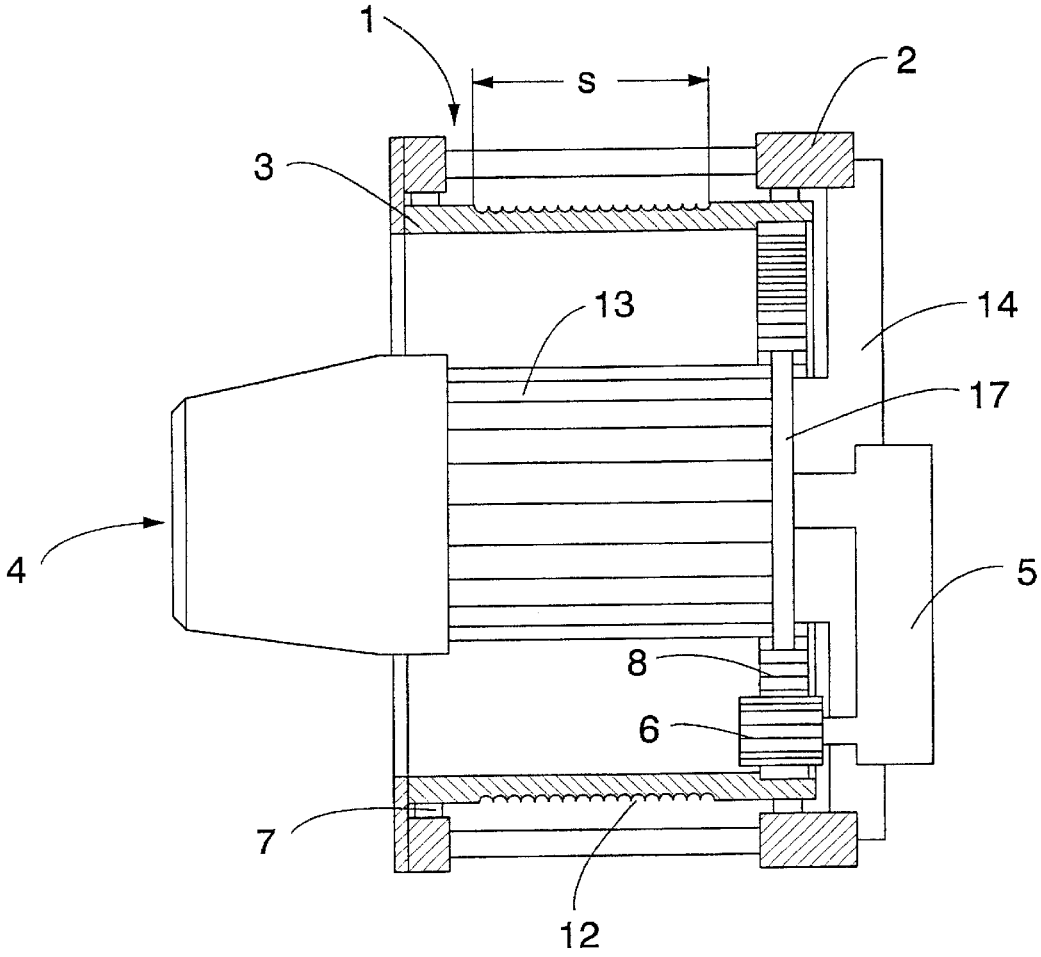

This is a continuation of PCT/FI00/01085, filed on Dec. 12, 2000.

The invention relates to a hoisting apparatus comprising a frame, a rope drum provided with a groove, a hoisting motor, a gear and a pinion in such a way that the hoisting motor is at least partly positioned inside the rope drum supported against the frame by its both ends, and that the hoisting motor and the gear are supported against the frame only by one end of the rope drum, by which end the hoisting motor and the gear are arranged to rotate the rope drum via the pinion.

The hoisting apparatus is generally a part of a rope hoist which is either fixedly mounted or moving along a track by means of a trolley. The hoisting apparatus can also be used as such to lift a load. In rope hoists intended for vertical transfer of a load, the length of the hoisting apparatus is a significant problem because it limits the travel of the trolley. The great length of the hoisting apparatus results from the basic idea of the rope hoist design, i.e. the tendency to minimize the diameter of the rope drum to optimize the force-transmitting gear, which leads to the great length of the rope drum and in this way of the whole rope hoist with hoisting heights and rope reevings commonly in use. Due to the tendency to minimize the diameter of the rope drum, the intention has typically been to dimension the ratio of the pitch circle diameter of the rope drum, i.e. the diameter of the centre of the groove, to the diameter of the hoisting rope to correspond to the standard minimum requirements in the most common utilization categories of existing rope hoists. Therefore, the ratio of the pitch circle diameter of the rope drum to the diameter of the hoisting rope is typically 16–25, depending on the intensity of use, whereby the length of the rope drum is significantly greater than the diameter of the rope drum. Since the length of the rope drum is the main factor in the total length of the hoisting apparatus and the whole rope hoist and since the direction of travel of the rope hoist mounted on the trolley is generally parallel to the longitudinal axis of the rope drum, the length of the rope drum is a significant problem because it limits the travel of the trolley. Further, the movement of the departure point of the hoisting rope on a long rope drum in the direction of the longitudinal axis of the rope drum during the rotational movement of the rope drum is great. In rope hoists with multiple ropes, when the departure point of the hoisting rope is displaced, i.e. when it drifts, the angle of departure of the hoisting rope leaving the rope drum changes relative to the longitudinal axis of the rope drum. The greater the drift and the more multiple the rope reeving, the greater the change in the angle of departure. Depending on the type of the rope, the maximum value of the angle of departure is 1.5° to 4°. When the maximum value is approached or exceeded, the hoisting rope wear is increased. Extensive drift of the hoisting rope can cause problems in the control of the load and result in a tendency of the hoisting hook to twist. The drift of the hoisting rope also causes problems in optimizing load-bearing structures, as the supporting forces vary depending on the departure point of the hoisting rope from the drum.

The known solutions to minimize the length of the hoisting apparatus include positioning either the hoisting motor or the gear or both as well as the pinion inside the rope drum, or positioning the hoisting motor beside the rope drum. According to the first alternative, the shortest length of the hoisting apparatus has been achieved by positioning the hoisting motor, the gear and the pinion inside the rope drum in the direction of the longitudinal axis of the rope drum; however, as the diameter of the rope drum is as small as possible, this solution causes the hoisting motor to heat intensively due to the small cooling space. The structure also requires a firm frame at both ends of the rope drum and an intermediate shaft exposed to vibration between the hoisting motor and the gear. Positioning the hoisting motor beside the rope drum increases the width of the rope hoist, but the total length of the rope hoist is still determined on the basis of the length of the rope drum.

An object of this invention is to provide a hoisting apparatus of a new type, short in the longitudinal direction.

The hoisting apparatus according to the invention is characterized in that the pinion is positioned between a cylinder, which is parallel to the longitudinal axis of the rope drum and defined by the housing of the hoisting motor, and the rope drum.

An essential idea of the invention is that in the hoisting apparatus intended for vertical transfer of a load, the hoisting motor is at least partly positioned inside the rope drum supported against the frame of the hoisting apparatus by both ends thereof, and that the hoisting motor and the gear transmitting force from the hoisting motor to the pinion is supported against the frame by only one end of the rope drum, by which end the hoisting motor and the gear are arranged to rotate the rope drum via a pinion positioned between a cylinder, which is parallel to the longitudinal axis of the rope drum and defined by the housing of the hoisting motor, and the rope drum. According to a preferred embodiment of the invention, the diameter of the rope drum is significantly greater than the diameter of the hoisting motor. According to a second preferred embodiment of the invention, the hoisting motor is positioned inside the rope drum asymmetrically relative to the centre of the rope drum. According to a third preferred embodiment of the invention, the torque required for the rotation of the rope drum is transmitted to the rope drum via the periphery thereof at the departure point of the hoisting rope from the rope drum.

An advantage of the invention is that the outer dimensions of the hoisting apparatus and in this way of the whole rope hoist are small in the direction of the longitudinal axis of the rope drum. Owing to the significantly greater diameter of the rope drum compared with the known solutions, it is possible, while the hoisting height remains constant, to use a significantly shorter rope drum. Owing to this, the horizontal movement of the hoisting rope in connection with the hoisting or lowering of a load is small, and detrimental horizontal movement of the load is thus decreased. Owing to the small horizontal movement of the hoisting rope, the rope force is divided almost evenly over the load-bearing structures, enabling small and light supporting structures, which can further be utilized in the dimensioning of the trolley of the rope hoist and of the bridge girder supporting it. Since the angle of departure of the hoisting rope from the rope drum is small and since the ratio of the pitch circle diameter of the rope drum to the diameter of the rope can be dimensioned up to 2- to 3-fold compared with the minimum values commonly in use and allowed by the standards, the durability of the rope is significantly increased. Furthermore, the small horizontal movement of the hoisting rope and the small rope angle together efficiently reduce the twisting risk of the hoisting hook supported by the rope. Owing to the small horizontal movement of the hoisting rope, the hoisting apparatus according to the invention allows construction of a rope hoist with up to 12-fold rope reeving without exceeding the rope angle of 4°. Since the inner diameter of the rope drum is significantly greater than the outer diameter of the hoisting motor and since the hoisting motor and the gear are supported against the frame by only one end of the rope drum, it is possible to arrange better ventilation for the hoisting motor compared with a hoisting motor positioned outside the rope drum, whereby there are no problems with the heating of the hoisting motor. A further advantage is that the structure is easy to modulate because the length of the rope drum does not affect the supporting of the hoisting motor and the gear attached thereto. Positioning the hoisting motor asymmetrically relative to the centre of the rope drum allows the gear to be designed more freely. Further, when the torque required for rotating the rope drum is transmitted to the rope drum via the periphery thereof at the departure point of the hoisting rope from the drum, the dimensioning of the hoisting motor of the hoisting apparatus and of the gear attached thereto can be optimized, and the hoisting height can be changed by changing either the diameter or the length of the rope drum.

Figure 2:
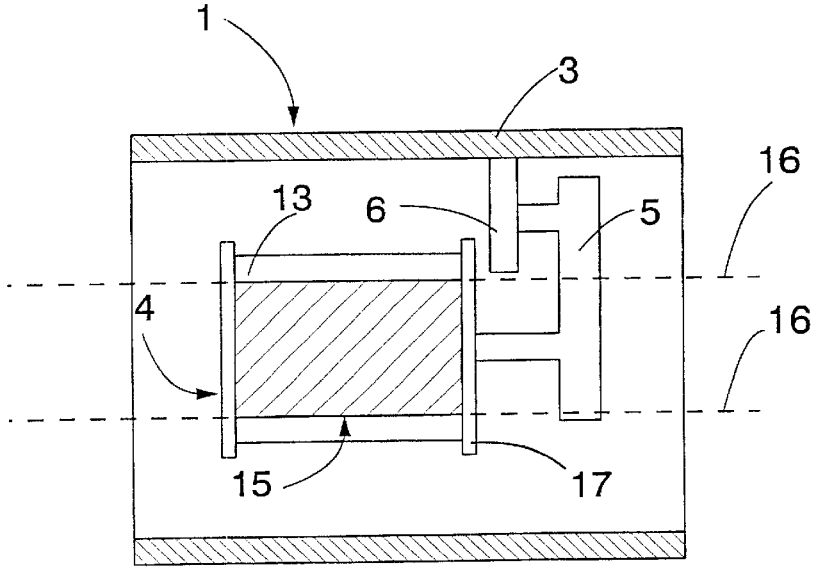
Figure 3:
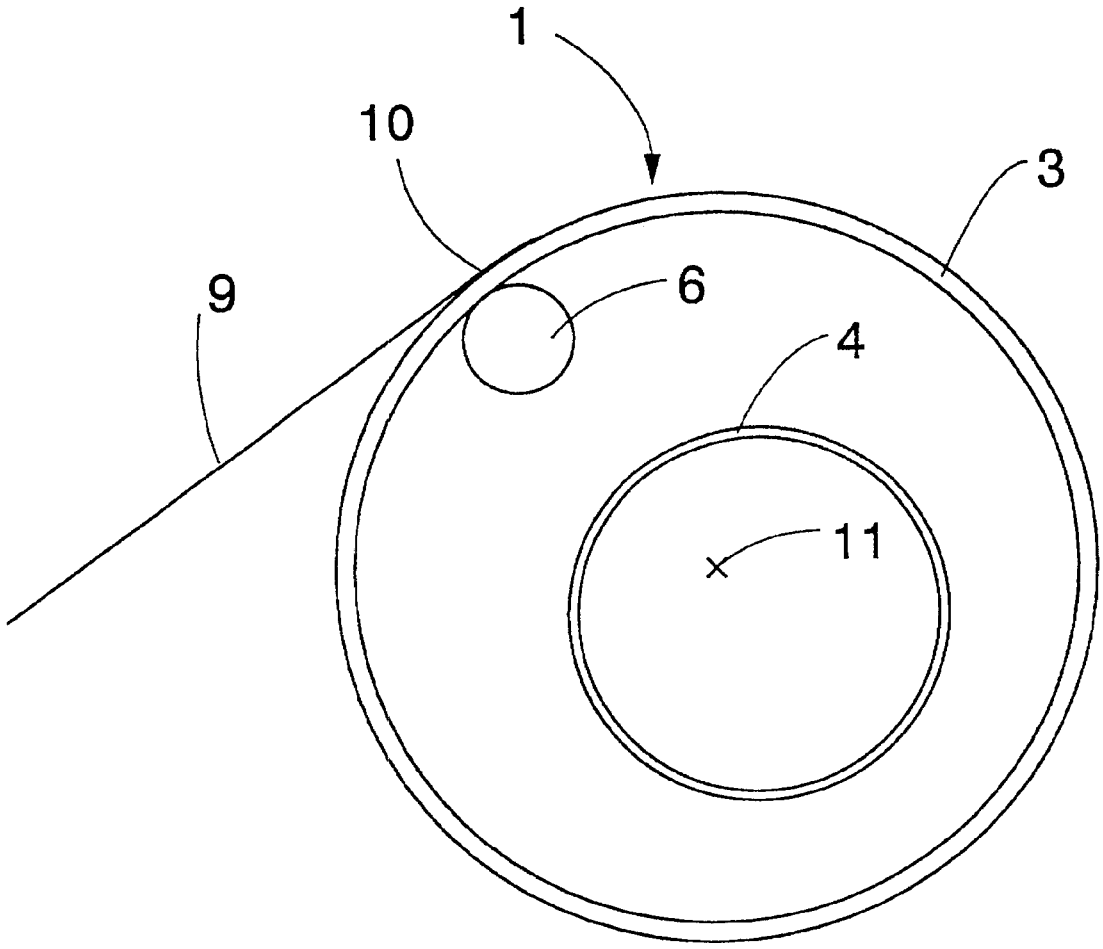

The invention will be described in more detail with reference to the attached drawings, in which FIG. 1 shows a schematic view of an embodiment of a hoisting apparatus according to the invention as a partial cross-section;

FIG. 2 shows a schematic principle view of a second embodiment of a hoisting apparatus according to the invention as a partial cross-section; and FIG. 3 shows a schematic principle view of a third embodiment of a hoisting apparatus according to the invention, seen from the end of the hoisting apparatus.

FIG. 1 schematically shows a hoisting apparatus 1 as a partial cross-section. The hoisting apparatus 1 comprises a frame 2 and a rope drum 3, which is supported against the frame 2 by both ends via bearings 7. The outer surface of the rope drum 3 is provided with a pitched groove 12, to which the hoisting rope is guided onto a single plane parallel to the rope drum 3, while the rope drum 3 is rotating. The outer diameter of the rope drum 3 is substantially constant over the whole length of the groove 12. For the sake of clarity, FIG. 1 does not show the hoisting rope. Instead of the hoisting rope, a chain, a belt or other corresponding hoisting means can be used as the hoisting means. Further, the hoisting apparatus 1 comprises a hoisting motor 4, which is positioned in the direction of its longitudinal axis at least partly inside the rope drum 3 in such a way that the centres of the rope drum 3 and the hoisting motor 4 are united. In connection with the hoisting motor 4, a cooling rib arrangement 13 of the hoisting motor 4 is shown, which surrounds the housing of the hoisting motor 4. Further still, the hoisting apparatus 1 comprises a gear 5 or a gear system 5, which transmits the force of the hoisting motor 4 to a pinion 6 positioned between the rope drum 3 and the hoisting motor 4, the pinion 6 being arranged to rotate the rope drum 3 via a gear rim 8 on its inner periphery. The pinion 6 is positioned partly between the rope drum 3 and the hoisting motor 4 in the direction of the longitudinal axis of the rope drum 3. The pinion 6 can be positioned completely outside the space between the rope drum 3 and the hoisting motor 4 in the direction of the longitudinal axis of the rope drum 3, but preferably the pinion 6 is positioned at least partly between the rope drum 3 and the hoisting motor 4. In FIG. 1, the gear 5 partly extends to the inside of the rope drum 3 in the direction of the longitudinal axis of the rope drum 3. The gear 5 can also be positioned completely outside the rope drum 3, depending on the space that is required for the gear 5, but preferably the gear 5 is positioned at least partly inside the rope drum 3. The hoisting motor 4 and the gear 5 are supported against the frame 2 by only that end of the rope drum 3 by which the hoisting motor 4 and the gear 5 are arranged to rotate the pinion 6. The hoisting motor 4 is supported against the frame 2 by means of a supporting member 14 in such a way that the hoisting motor 4 is attached to the supporting member 14 by a flange 17. The diameter of the flange 17 is typically greater than the diameter of the cooling rib arrangement 13. The gear 5 is supported against the flange 17 of the hoisting motor 4. The gear 5 can also be supported against the supporting member 14. The supporting of the hoisting motor 4 and the gear 5 against the frame 2 can be implemented in a plurality of ways, and FIG. 1 only shows one option for implementing the supporting. The position of the pinion 6 on the inner periphery of the rope drum 3 can be decided freely, but preferably the pinion 6 is positioned in the way shown in FIG. 3, i.e. at the departure point 10 of a hoisting rope 9, at which point the hoisting rope 9 leaves the rope drum 3.

According to a preferred embodiment of the invention, the diameter of the rope drum 3 can in the hoisting apparatus 1 of FIG. 1 be designed essentially greater than the diameter of the housing 15 of the hoisting motor 4 shown in FIG. 2, for example in such a way that the diameter of the housing 15 of the hoisting motor 4 is ⅔ of the diameter of the rope drum 3, in other words the diameter of the rope drum 3 is significantly greater than in the known solutions. The rope drum 3 can be dimensioned in such a way that the ratio of the pitch circle diameter of the rope drum 3 to the diameter of the hoisting rope 9 is for example 30–60, i.e. about 2- to 3-fold compared with the known solutions. The ratio can as well be more than 60. Preferably, this dimensioning means that the drift of the hoisting rope 9 on the rope drum 3 is smaller than or equal to the pitch circle diameter of the rope drum 3, in other words the length S of the groove 12 in the direction of the longitudinal axis of the rope drum 3 is at the most equal to the pitch circle diameter of the rope drum 3.

FIG. 2 schematically shows a principle view of a second hoisting apparatus 1 according to the invention as a partial cross-section. For the sake of clarity, FIG. 2 only shows the most essential components of the embodiment according to FIG. 2. The housing 15 of the hoisting motor 4 defines a cylindrical surface parallel to the longitudinal axis of the rope drum 3 at the point of the hoisting motor 4 and its imaginary extension, as illustrated by broken lines 16. The pinion 6 is positioned between said cylindrical surface illustrated by broken lines 16 and the rope drum 3. In the direction of the longitudinal axis of the rope drum 3, the pinion 6 is positioned outside the space between the hoisting motor 4 and the rope drum 3 due to the space required for the cooling rib arrangement 13 of the hoisting motor 4. The dimensioning of the cooling rib arrangement 13 depends on the cooling requirement for the hoisting motor 4. The cooling rib arrangement 13 can be shortened and the end flange 17 of the hoisting motor 4 can be shaped in such a way that there will be sufficiently space for the pinion 6 between the housing 15 of the hoisting motor 4 and the rope drum 3, whereby, in other words, the pinion 6 can be positioned between the housing 15 of the hoisting motor 4 and the rope drum 3. The gear 5 transmitting the force of the hoisting motor 4 to the pinion 6 is in FIG. 2 arranged completely inside the rope drum 3.

FIG. 3 schematically shows a principle view of a third hoisting apparatus 1 according to the invention, seen from the end thereof. For the sake of clarity, FIG. 3 only shows the most essential components of the embodiment according to FIG. 3. In FIG. 3, the hoisting motor 4 is positioned asymmetrically relative to the centre 11 of the rope drum 3, and the pinion 6 is positioned between the rope drum 3 and the hoisting motor 4. FIG. 3 also shows how the departure point 10 of the hoisting rope 9 on the rope drum 3 is at the point of the pinion 6, whereby the dimensioning of the hoisting motor 4 of the hoisting apparatus 1 and the gear 5 attached thereto can be optimized. However, the departure point 10 of the hoisting rope 9 from the drum does not have to be located at the point of the pinion 6.

FIG. 3 shows, by way of example only, an alternative for the asymmetrical position of the hoisting motor 4 inside the rope drum 3. The asymmetrical position of the hoisting motor 4 relative to the centre 11 of the rope drum 3 can also be different from that shown in FIG. 3. Preferably, the pinion 6 is located at the departure point 10 of the hoisting rope 9 from the drum, but this is not necessary.

The drawings and the related specification are only intended to illustrate the idea of the invention. The details of the invention can vary within the scope of the claims. The range of use of the hoisting apparatus 1 is not limited in any way, and the hoisting apparatus 1 can be either fixedly mountable or mountable on a trolley. The hoisting apparatus 1 according to the invention does not limit the structure of the rope reeving of the rope hoist, nor does it limit the number of hoisting ropes 9. The gear 5 used in the hoisting apparatus 1 can be selected freely, and the pinion 6 is not necessarily a separate component but can be arranged as a part of the gear 5.

What is claimed is:

1. A hoisting apparatus comprising a frame, a rope drum provided with a groove, a hoisting motor, a gear and a pinion in such a way that the hoisting motor is at least partly positioned inside the rope drum, said rope drum being supported against the frame by both ends of said rope drum, and that the hoisting motor and the gear are supported against the frame only by one end of the rope drum, by which end the hoisting motor and the gear are arranged to rotate the rope drum via the pinion, and that the pinion is positioned at least partly between the inner periphery of the rope drum and the hoisting motor in the direction of the longitudinal axis of the rope drum.

2. A hoisting apparatus according to claim 1, wherein the diameter of the rope drum is significantly greater than the diameter of the housing of the hoisting motor.

3. A hoisting apparatus according to claim 1, wherein the length of the groove of the rope drum in the direction of the longitudinal axis of the rope drum is at the most equal to the pitch circle diameter of the rope drum.

4. A hoisting apparatus according to claim 3, wherein the ratio of the pitch circle diameter of the rope drum to the diameter of the hoisting rope is at least 30.

5. A hoisting apparatus according to claim 3, wherein the ratio of the pitch circle diameter of the rope drum to the diameter of the hoisting rope is 30–60.

6. A hoisting apparatus according to claim 1, wherein the hoisting motor is positioned asymmetrically relative to the centre of the rope drum.

7. A hoisting apparatus according to claim 1, wherein the pinion is positioned at the departure point of the hoisting rope from the drum.

8. A hoisting apparatus according to claim 1, wherein the gear is at least partly inside the rope drum.

9. A hoisting apparatus according to claim 1, wherein the pinion is arranged as a part of the gear.

* * * * *